US010086980B2

(12) United States Patent
Isogai

(10) Patent No.: US 10,086,980 B2
(45) Date of Patent: Oct. 2, 2018

(54) CONTAINER SEALING DEVICE

(71) Applicant: Tokan Kogyo Co., Ltd., Tokyo (JP)

(72) Inventor: Takamitsu Isogai, Tokyo (JP)

(73) Assignee: Tokan Kogyo Co., Ltd., Tokyo (JP)

( * ) Notice: Subject to any disclaimer, the term of this patent is extended or adjusted under 35 U.S.C. 154(b) by 0 days.

(21) Appl. No.: 14/762,417

(22) PCT Filed: Jan. 24, 2014

(86) PCT No.: PCT/JP2014/051577
§ 371 (c)(1),
(2) Date: Jul. 21, 2015

(87) PCT Pub. No.: WO2014/115856
PCT Pub. Date: Jul. 31, 2014

(65) Prior Publication Data

US 2015/0321798 A1 Nov. 12, 2015

(30) Foreign Application Priority Data

Jan. 25, 2013 (JP) ..... 2013-012712

(51) Int. Cl.
*B65D 47/36* (2006.01)
*B65D 51/22* (2006.01)
(Continued)

(52) U.S. Cl.
CPC ..... *B65D 39/0052* (2013.01); *B65D 39/08* (2013.01); *B65D 47/106* (2013.01);
(Continued)

(58) Field of Classification Search
CPC ..... B65D 51/228; B65D 2251/0028; B65D 2251/009; B65D 5/748; B65D 2251/0037;
(Continued)

(56) References Cited

U.S. PATENT DOCUMENTS 4,024,952 A * 5/1977 Leitz ..... B65D 51/2878 206/221
4,386,696 A * 6/1983 Goncalves ..... B65D 51/2871 206/219
(Continued)

FOREIGN PATENT DOCUMENTS

CN 101535143 A 4/2007
CN 102114937 A 7/2011
(Continued)

OTHER PUBLICATIONS

Extended European Search Report dated Aug. 17, 2016 in European Patent Application No. 14743921.0.
(Continued)

*Primary Examiner* — J. Gregory Pickett
*Assistant Examiner* — Gideon Weinerth
(74) *Attorney, Agent, or Firm* — Knobbe Martens Olson & Bear LLP

(57) ABSTRACT

An object is to provide a container sealing device which can perform an opening of an inner plug with a clear opening feeling. An inner plug 10 is assembled in advance to an upper closure 20 by using a second screwing part 52. At this time, since an assembling interval between a separation part 12 and the upper closure 20 can be adjusted by tip end parts 16*t* and 20*u* of a cylindrical part 16 which are first stoppers and the small-diameter cylinder part 20*d*, the second screwing part 52 can be brought into a lock state of being screwed to the deepest position or a state close to that. In opening the plug, the first screwing part 51 is loosened the second screwing part 52 is tightened, and the separation part 12 can be rapidly and reliably separated from a body part 10*b* of the inner plug 10.

10 Claims, 6 Drawing Sheets

(51) Int. Cl.
*B65D 39/00* (2006.01)
*B65D 39/08* (2006.01)
*B65D 47/10* (2006.01)
*B65D 47/12* (2006.01)

(52) U.S. Cl.
CPC ..... *B65D 47/123* (2013.01); *B65D 51/228* (2013.01); *B65D 2251/0015* (2013.01); *B65D 2251/0087* (2013.01)

(58) Field of Classification Search
CPC ..... B65D 2251/01; B65D 2251/04; B65D 47/063; B65D 47/36; B65D 47/106; B65D 47/123; B65D 47/121; B65D 47/142; B65D 55/022; B65D 51/18; B65D 51/2814; B65D 2251/0015; B65D 2251/0087; B65D 39/0052; B65D 39/08; B65B 7/2835
USPC ..... 215/256, 253, 49, 277, 252, 329, 44, 45; 220/277; 222/81, 83
See application file for complete search history.

(56) References Cited

U.S. PATENT DOCUMENTS 4,615,437 A * 10/1986 Finke ..... B65D 51/28 206/222
4,793,475 A * 12/1988 Itzel ..... B65D 51/2814 206/219
5,678,735 A 10/1997 Rical
6,382,462 B1 * 5/2002 Ostergaard-Nielsen ..... B65D 5/749 222/1
6,422,412 B1 * 7/2002 Sagawa ..... B65D 5/748 220/277
6,942,114 B2 * 9/2005 Nishida ..... B65D 41/3438 215/252
7,588,142 B1 * 9/2009 Bush ..... B65D 51/2857 206/221
8,104,633 B2 * 1/2012 Ramsey ..... B65D 51/2864 215/44
8,235,232 B2 8/2012 Isogai et al.
2009/0308834 A1 * 12/2009 Isogai ..... B65D 47/0838 215/329
2011/0226770 A1 * 9/2011 Tiesberger ..... B65D 51/2864 220/254.8
2013/0058595 A1 * 3/2013 Ekenhorst ..... B65D 5/748 383/80
2013/0256336 A1 * 10/2013 Himmelsbach ..... B65D 5/748 222/81
2014/0190973 A1 * 7/2014 Kerman ..... B65D 35/44 220/278
2015/0321798 A1 * 11/2015 Isogai ..... B65D 47/106 215/253
2015/0353247 A1 * 12/2015 Isogai ..... B65D 5/746 215/252
2016/0167849 A1 * 6/2016 Isogai ..... B65D 51/22 215/296
2016/0244224 A1 * 8/2016 Isogai ..... B65D 47/123
2016/0288967 A1 * 10/2016 Isogai ..... B65D 47/36
2017/0225851 A1 * 8/2017 Wada ..... B65D 47/121

FOREIGN PATENT DOCUMENTS

EP 0001959 10/1978
EP 0355471 A1 2/1990
EP 2266883 A1 12/2010
FR 2609970 1/1987
FR 2770832 A1 5/1999
JP S50 112544 9/1975
JP 54-103189 A 8/1979
JP 55-20603 Y2 5/1980
WO WO 99/42375 8/1999
WO WO 2007/126062 A1 11/2007

OTHER PUBLICATIONS

Office Action dated Jun. 2, 2016 in Chinese Application No. 201480006070.6.
International Preliminary Report on Patentability for International Application No. PCT/JP2014/051577 dated Jul. 28, 2015.
Office Action dated Jan. 25, 2017 in Chinese Application No. 201480006070.6.
Office Action dated Jun. 13, 2017 issued in Japanese Application No. 2014-558636.
European Search Report dated May 8, 2017, issued in Application No. 14867122.5.

* cited by examiner

CONTAINER SEALING DEVICE

CROSS-REFERENCE TO RELATED APPLICATIONS

This application is the U.S. National Phase under 35 U.S.C. § 371 of International Application PCT/JP2014/051577, filed Jan. 24, 2014, which claims priority to Japanese Patent Application No. JP 2013-012712, filed Jan. 25, 2013, the entirety of which is incorporated herein by reference.

TECHNICAL FIELD

The present invention relates to a container sealing device to be attached to a bottle-shaped container.

BACKGROUND ART

As a known cap structure (sealing device) used for a container with a closure, there is a structure which is provided with an inner plug and an upper closure, and in which a cylindrical part fitted with an opening part of a bottle and a separation part continuously provided on an inner side thereof via a score are provided in the inner plug (refer to FIGS. 1 and 2 in Patent Literature 1).

In this cap structure, the upper closure is preliminarily engaged (screwed) with the separation part of the inner plug through, for example, a forward thread or reverse thread. As a result, a movement difference can be generated between the separation part of the inner plug and the upper closure by screwing backward so as to remove the upper closure from the opening part (forward thread) of the bottle when opening the plug, whereby the separation part is separated from the cylindrical part of the inner plug and the separation part is held by the upper closure. According to this cap structure, the upper closure can be easily opened only by rotating the upper closure so as to be loosened, and the separation part separated by opening the plug is held on an inner cylinder on an upper end of the upper closure, and thus the separation part after separation can be made to function as a seal, whereby the separation part does not become so-called rubbish.

Incidentally, in the cap structure in Patent Literature 1, the structure is such that, when opening the plug, a movement difference is generated between the separation part and the upper closure by rotation of the separation part of the inner plug through the reverse thread or forward thread with respect to the upper closure, and thus there is a problem in which the separation part is not separated until the movement difference reaches a certain level or more as long as a cutting member having an edge is not provided in a supplementary manner. Particularly, in the case of the forward thread, the movement difference becomes less likely to be generated, and even in the case of the reverse thread, a feeling of snap-opening of the plug (clear opening feeling) is less likely to be generated.

CITATION LIST

Patent Literature

PTL 1: International Publication No. WO2007/126062

SUMMARY OF INVENTION

The present invention has been made in view of the aforementioned background art and an object is to provide a container sealing device which can perform an opening of the inner plug with a clear opening feeling.

In order to solve the aforementioned problem, the container sealing device according to the present invention is a container sealing device provided with an inner plug and an upper closure and enabling attachment and detachment of the upper closure by a first screwing part provided between the upper closure and the container or the inner plug, wherein: the upper closure has a support part catching a separation part provided in the inner plug by a second screwing part in opening the plug, and separating the separation part from the inner plug; the second screwing part is in a reverse thread relation with respect to the first screwing part; and a first stopper regulating a mutual assembling interval is provided between the separation part of the inner plug and the upper closure.

In the aforementioned container sealing device, the separation part or the inner plug is assembled in advance to the upper closure by using the second screwing part. At this time, since the assembling interval between the separation part and the upper closure can be adjusted by the first stopper, the second screwing part can be brought into a lock state of being screwed to the deepest position or a state close to that. Sealing of the sealing device becomes possible by pushing in or screwing the upper closure to the container or the inner plug. In opening the plug, the upper closure is rotated in a direction of being loosened with respect to the container. Namely, the first screwing part is loosened by rotating the upper closure so as to be screwed back, but along with that, the second screwing part which has been already substantially locked is tightened, and rapid and reliable separation of the separation part from the body part of the inner plug is facilitated. Therefore, after separation, that is, after opening the plug, the separation part becomes less likely to be removed from the upper closure, and is reliably held. As described above, a clear opening feeling such as generation of a snap sound or sudden reduction in resistance against rotation can be presented by separating the separation part from the body part of the inner plug while tightening the second screwing part which has been substantially locked. Note that the separation part is considered to be fixed to the support part in advance by causing the second screwing part to have a mere fitting structure of irregularity, but an undercut part required to be provided in a molding die for the upper closure and the like, and it becomes difficult to withdraw the upper closure and the like from the die. On the other hand, it becomes no longer necessary to provide the undercut part in the molding die by adoption of a thread shape as a method of fixing the separation part and the support part as in the second screwing part, and the difficulty in the process of withdrawing the upper closure and the like from the die can be overcome extremely easily.

In a specific aspect or viewpoint of the present invention, in the aforementioned container sealing device, the inner plug has a body part and a separation part that forms an opening by being separated from the body part, and the upper closure is attached to the container so as to cover the inner plug.

In another viewpoint of the present invention, the support part has a first inner cylinder part extending downward from a lower surface of a ceiling wall of the upper closure, the separation part has a cylindrical part extending upward from a sealing body connected to the body part of the inner plug, and the second screwing part is provided between the first inner cylinder part of the support part and the cylindrical part of the separation part.

In still another viewpoint of the present invention, the second screwing part has a male thread formed on an outer side surface of the first inner cylinder part of the support part and a female thread formed on an inner side surface of the cylindrical part of the separation part. In this case, since the separation part fixed to the support part covers the support part, the separation part or the opening has a relatively large diameter.

In still another viewpoint of the present invention, the first stopper is provided at least at either one of a lower end of the support part and an upper end of the separation part. That is, the first stopper utilizes contact between the support part and the separation part.

In still another viewpoint of the present invention, the first stopper is provided at least at either one of a lower end of the first inner cylinder part provided at the support part and an upper end of the cylindrical part extending upward from the sealing body provided on the separation part. In this case, an assembling interval between the upper closure and the body part can be accurately adjusted by length adjustment in an axial center direction of the first inner cylinder part or the cylindrical part. Moreover, support of the separation part is made stable, and a sealing function can also be given to the first stopper.

In still another viewpoint of the present invention, a second stopper regulating the mutual assembling interval is provided between the upper closure and the body part of the inner plug. In this case, when the inner plug is assembled to the upper closure or the upper closure is attached to the container or the inner plug, excessive pushing-in of the body part into the upper closure can be prevented, and occurrence of damage to the separation part can be reliably prevented.

In still another viewpoint of the present invention, the second stopper is provided at a lower end of a second inner cylinder part provided on the upper closure. In this case, the assembling interval between the upper closure and the body part can be accurately adjusted by length adjustment in an axial center direction of the second inner cylinder part.

In still another viewpoint of the present invention, the upper closure has a recess part in which a tip end of the cylindrical part extending upward from the sealing body of the separation part is accommodated. In this case, the separation part is firmly held by the upper closure due to friction resistance with the recess part.

In still another viewpoint of the present invention, a score is provided between the body part of the inner plug and the separation part. In this case, sealing of the inner plug by the separation part is made reliable, and separation of the separation part is also facilitated.

DESCRIPTION OF EMBODIMENTS

Figure 1:
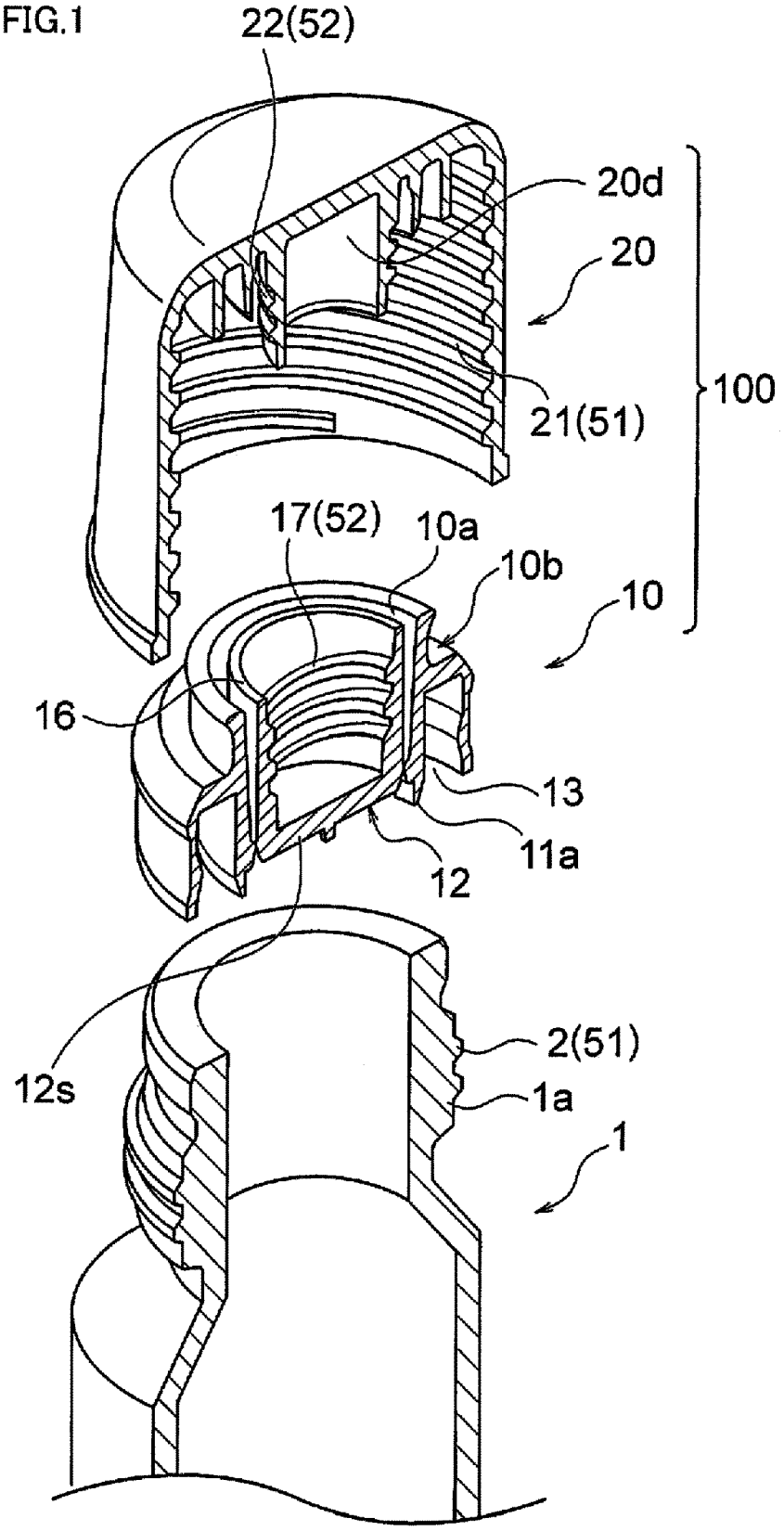
FIG. 1 is an exploded cross-sectional perspective view for explaining an embodiment of a container sealing device according to the present invention.

FIGS. 1 to 5 illustrate an embodiment of a container sealing device according to the present invention.

An illustrated sealing device 100 is constituted of an inner plug 10 locked by a mouth part 1*a* of a container 1 through fitting or the like, and an upper closure 20 screwed with the mouth part 1*a* of the container 1 so as to cover an extraction port 10*a* of the inner plug 10.

The inner plug 10 is an integrally molded product made of a resin and is provided with a body part 10*b* locked by or fixed to the container 1 and a separation part 12.

Figure 2:
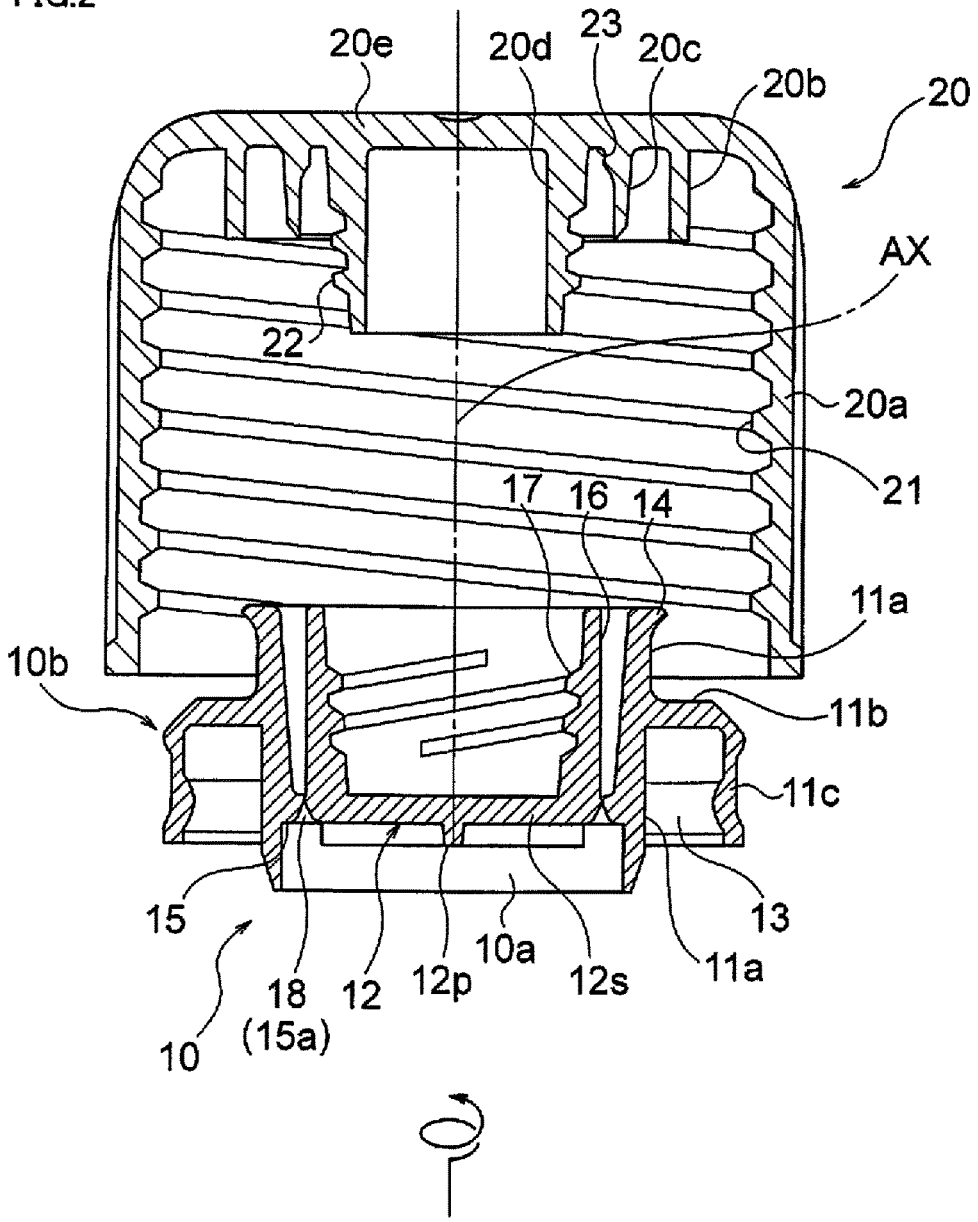
FIG. 2 is a cross-sectional view illustrating an inner plug and an upper closure of the sealing device illustrated in FIG. 1.

As illustrated in FIG. 2 and the like, the body part 10*b* of the inner plug 10 forms the extraction port 10*a* of a content of the container 1 and has a cylindrical base part 11*a* which is a cylindrical member extending along an axial center AX, a flange part 11*b* extending outward in a radial direction from an outer peripheral surface of an intermediate part of the cylindrical base part 11*a*, and an annular wall part 11*c* which is an annular member extending downward from an outer end of the flange part 11*b*. These cylindrical base part 11*a*, the flange part 11*b*, and the annular wall part 11*c* define an annular recess part 13 fitted with the mouth part 1*a* of the container 1. In addition, a lip part 14 extending outward is formed at an upper end of the cylindrical base part 11*a*.

The separation part 12 of the inner plug 10 is provided with a disc-shaped sealing body 12*s* arranged on a bottom part and a cylindrically-shaped cylindrical part 16 extending upward from an outer edge of this sealing body 12*s*. An outer-periphery side boundary part between the outer edge of this sealing body 12*s* and a lower end part of the cylindrical part 16 is connected to the body part 10*b* of the inner plug 10 by an annular connection part 15. An annular notch 18 is formed on a lower surface of the connection part 15. This notch 18 serves as a part of a score 15*a* cut off when opening the plug. A cross-shaped protrusion part 12*p* is provided on the lower surface side of the sealing body 12*s*, in order to facilitate screwing of the inner plug 10 into the upper closure 20 by rotating the inner plug 10 including the separation part 12 when the inner plug 10 is assembled to the upper closure 20. The cylindrical part 16 is arranged concentrically and separately inside the cylindrical base part 11*a* on an outer side. There is formed a female thread 17 to be screwed with a male thread 22 provided on a small-diameter cylinder part 20*d* of the upper closure 20 which will be described later, on an inner peripheral surface of the cylindrical part 16.

The upper closure 20 is an integrally molded product made of a resin and is provided with a cylindrical peripheral wall part 20*a* which forms an appearance; and a large-diameter cylinder part (second inner cylinder part) 20*b*, a middle-diameter cylinder part 20*c*, and the small-diameter cylinder part (first inner cylinder part) 20*d* concentrically with the peripheral wall part 20*a* therein, and they are continuously provided by a ceiling wall 20*e*. A female thread 21 screwed with a male thread 2 formed on the outer peripheral side surface of the mouth part 1*a* of the container 1 is formed on an inner peripheral surface of the peripheral wall part 20*a*, and the male thread 22 screwed with the female thread 17 formed on the inner peripheral side surface of the cylindrical part 16 of the separation part 12 provided on the inner plug 10 is formed on an outer peripheral surface of the small-diameter cylinder part (first inner cylinder part) 20*d*.

In the above, the female thread 21 of the peripheral wall part 20*a* of the upper closure 20 and the male thread 2 of the mouth part 1*a* of the container 1 constitute a first screwing part 51 which enables attachment and detachment of the upper closure 20 with respect to the container 1. Furthermore, the female thread 17 of the cylindrical part 16 of the inner plug 10 and the male thread 22 of the small-diameter cylinder part (first inner cylinder part) 20*d* of the upper closure 20 constitute a second screwing part 52 for tightening and fixing the separation part 12 of the inner plug 10 to the small-diameter cylinder part 20*d* of the upper closure 20. That is, the small-diameter cylinder part 20*d* of the upper closure 20 functions as a support part for catching the separation part 12 by the second screwing part 52 and separating the separation part 12 from the inner plug 10. The first screwing part 51 and the second screwing part 52 are in a mutually reverse thread relation. Namely, when the first screwing part 51 is screwed back so as to be loosened by rotating the peripheral wall part 20*a* of the upper closure 20 in a counterclockwise direction when seen from an upper side, the small-diameter cylinder part (support part) 20*d* of the upper closure 20 is rotated in a counterclockwise direction when seen from the upper side, and the second screwing part 52 is tightened. Here, for example, the screwing direction or the like of the second screwing part 52 will be described in detail. For thecylindrical part 16 of the inner plug 10, the upper side along the axial center AX is the screwing direction for screwing with the small-diameter cylinder part 20*d* of the upper closure 20 by rotation in the counterclockwise direction when seen from a lower side, whereas a lower side along the axial center AX is the anti-screwing direction for screwing back the small-diameter cylinder part 20*d* by rotation in the clockwise direction. For the small-diameter cylinder part 20*d*, the lower side along the axial center AX is the screwing direction for screwing with the cylindrical part 16 by rotation in the counterclockwise direction when seen from the upper side, whereas the upper side along the axial center AX is the anti-screwing direction for screwing back the cylindrical part 16 by rotation in the clockwise direction when seen from the upper side.

Figure 3A:
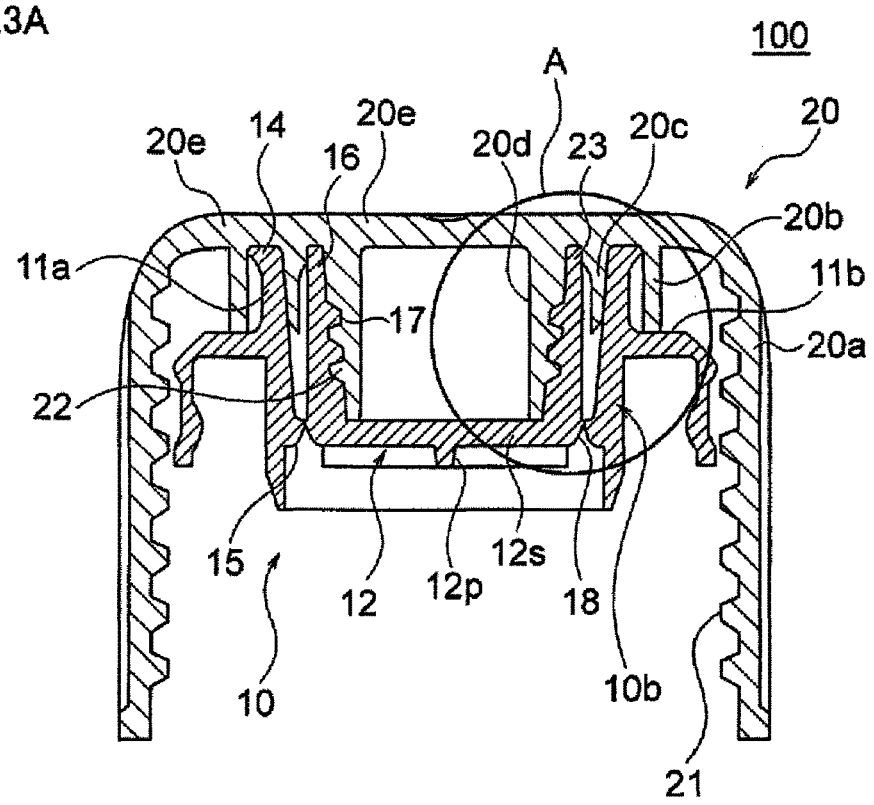
FIG. 3A is a cross-sectional view illustrating a state where the inner plug and the upper closure illustrated in FIG. 2 are assembled.
Figure 3B:
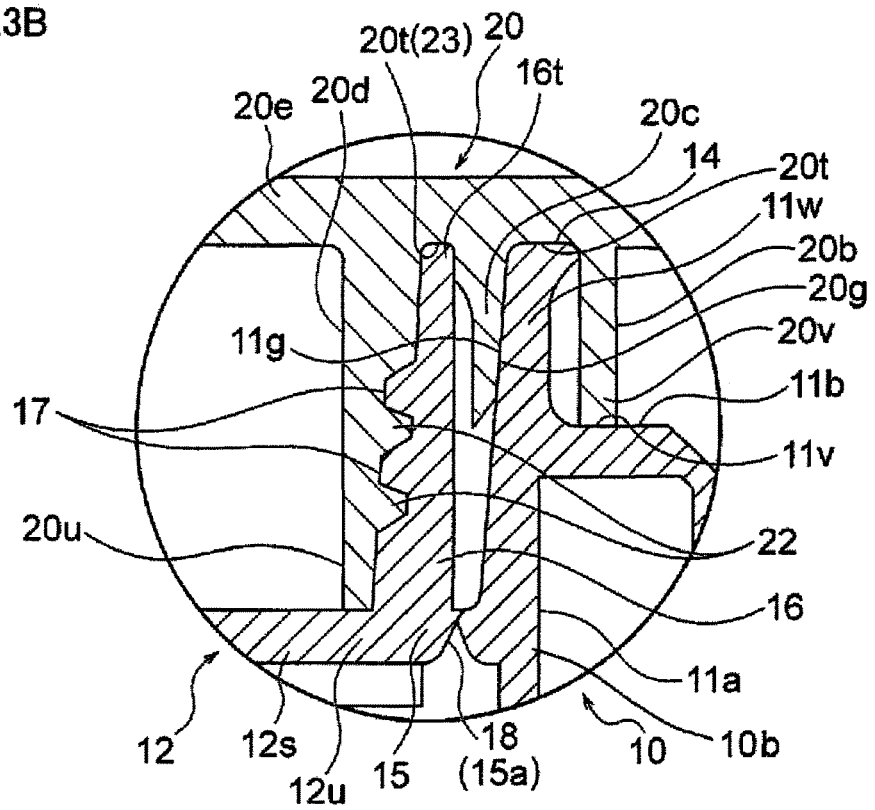
FIG. 3B is a partially enlarged view illustrating an A part in FIG. 3A in an enlarged manner.

As illustrated in FIGS. 3A and 3B, a tip end part 16*t* of the cylindrical part 16 of the inner plug 10 is brought into contact with a lower surface 20*t* of the ceiling wall 20*e* of the upper closure 20 exposed between the base part of the middle-diameter cylinder part 20*c* and the base part of the small-diameter cylinder part 20*d* of the upper closure 20. Similarly, a tip end part 20*u* of the small-diameter cylinder part 20*d* of the upper closure 20 is brought into contact with an inner-surface corner part 12*u* of the separation part 12 of the inner plug 10. The tip end part 16*t* of the cylindrical part 16 and the tip end part 20*u* of the small-diameter cylinder part 20*d* function as first stoppers for regulating their mutual assembling interval between the separation part 12 of the inner plug 10 and the upper closure 20. Furthermore, a tip end part 20*v* of the large-diameter cylinder part 20*b* of the upper closure 20 is in contact with an upper surface 11*v* of the flange part 11*b* of the inner plug 10. The tip end part 20*v* of the large-diameter cylinder part 20*b* functions as a second stopper regulating their mutual assembling interval between the upper closure 20 and the body part 10*b* of the inner plug 10. Note that an outer peripheral surface 20*g* of the middle-diameter cylinder part 20*c* provided at the upper closure 20 and an inner side surface 11*g* of a tip end part 11*w* provided at the cylindrical base part 11*a* of the inner plug 10 are in close contact with each other. As a result, when sealing after opening the plug, the inside of the container 1 can be kept liquid-tight.

The inner plug 10 and the upper closure 20 constituted as described above are screwed with each other by engaging the female thread 17 which is a reverse thread of the inner plug 10 with the male thread 22 which is a reverse thread of the upper closure 20, and by rotating the inner plug 10 in a counterclockwise direction when seen from the inner plug 10 side or by rotating the upper closure 20 in the counterclockwise direction when seen from the upper closure 20 side. When the inner plug 10 is supported in screwing, a tool can be utilized, and the protrusion part 12*p* of the separation part 12 is supported by a chuck part of the tool. The upper closure 20 and the inner plug 10 are tightened to the deepest position and integrated. Namely, the small-diameter cylinder part (first inner cylinder part) 20*d* of the upper closure 20 is fitted so as to be pushed into the inner plug 10 until the tip end part 16*t* of the cylindrical part 16 reaches a state of being brought into contact with the lower surface 20*t* of the ceiling wall 20*e* of the upper closure 20 or is screwed into the inner plug 10 until the tip end part 20*u* of the small-diameter cylinder part 20*d* reaches a state of being brought into contact with the inner-surface corner part 12*u* of the separation part 12 of the inner plug 10. At this time, the tip end part 20*v* of the large-diameter cylinder part (second inner cylinder part) 20*b* of the upper closure 20 is brought into contact with the upper surface 11*v* of the flange part 11*b* of the inner plug 10.

In the state where the inner plug 10 and the upper closure 20 are engaged with each other as above, the interval between the inner plug 10 and the upper closure 20 is adjusted, and as illustrated in FIG. 3B and the like, the tip end part 16*t* of the cylindrical part 16 is accommodated in a recess part 23 formed at a base part between the middle-diameter cylinder part 20*c* and the small-diameter cylinder part 20*d*. In addition, the lip part 14 formed at the tip end of the cylindrical base part 11*a* is positioned in a state of being brought into contact with the lower surface 20*t* of the ceiling wall 20*e* of the upper closure 20.

Figure 4:
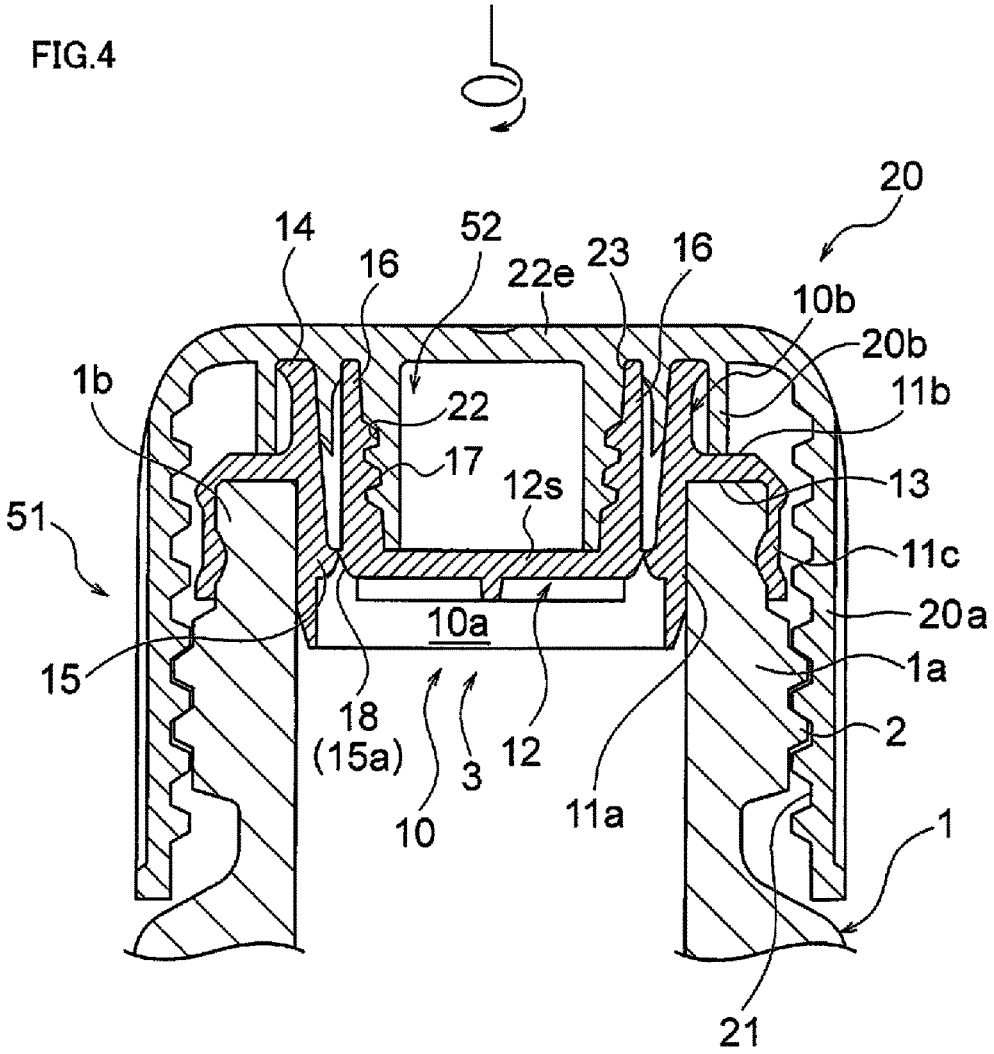
FIG. 4 is a cross-sectional view illustrating a state where the sealing device of the present embodiment is assembled to a container.

Then, the cap (an assembly of the inner plug 10 and the upper closure 20) assembled as described above is locked by the container 1 by fitting the annular recess part 13 defined by the cylindrical base part 11*a* of the inner plug 10, the flange part 11*b* and the annular wall part 11*c*, with the mouth part 1*a* of the container 1, as illustrated in FIG. 4. Namely, the upper closure 20 is screwed with the mouth part 1*a* of the container 1, and the body part 10*b* of the inner plug 10 reaches a state of being fitted air-tightly with the mouth part 1*a*. Specifically, the female thread 21 with a forward thread formed on the peripheral wall part 20*a* of the upper closure 20 is engaged with the male thread 2 with a forward thread formed on the mouth part 1*a* of the container 1, and, for example, the upper closure 20 is rotated in a clockwise direction when seen from the upper closure 20 side or the container 1 is rotated in the clockwise direction when seen from the container 1 side, whereby the both are screwed with each other. Here, when the annular wall part 11*c* and the like ride over a tip end 1*b* of the mouth part 1*a* of the container 1, the inner plug 10 is subjected to an action of screwing back by receiving a torque of a left thread. However, the inner plug 10 is pressed into the upper closure 20 by the mouth part 1*a* of the container 1, and the inner plug 10 is substantially fixed to the upper closure 20 and is hardly screwed back due to an influence of friction between the upper closure 20 and the inner plug 10 and the like. Furthermore, displacement of the body part 10*b* of the inner plug 10 is prevented by the tip end part 20*v* of the large-diameter cylinder part 20*b* which is the second stopper, and a relatively large load or stress is prevented from being applied to the separation part 12 via the body part 10*b*.

Not that, when the cap (the assembly of the inner plug 10 and the upper closure 20) is mounted on the mouth part 1*a* of the container 1, the assembly of the inner plug 10 and the upper closure 20 can also be capped (forcedly pushed in and fixed) instead of being screwed into the mouth part 1*a*. In this case, since there exists the tip end part 20*v* of the large-diameter cylinder part 20*b* which is the second stopper, large displacement of the body part 10*b* of the inner plug 10 with respect to the upper closure 20 can be avoided in capping, and damage can be prevented from being caused in the periphery of the separation part 12, by application of a relatively large load or stress to the separation part 12 via the body part.

Hereinafter, an opening operation or unsealing operation of the cap structure of the aforementioned embodiment will be described by referring to FIGS. 4 and 5.

First, as illustrated in FIG. 4, the upper closure 20 is at an initial position (a state of being screwed into the deepest position or close to that) before a rotating operation of the screwing part, while the separation part 12 and the cylindrical part 16 are in a connected state, that is, in a state where the score 15*a* of the connection part 15 is not cut off, and thus an opening part 3 of the container 1 is in a sealed state.

From this state, the upper closure 20 is moved upward by rotating the upper closure 20 in a loosening direction, that is, in a counterclockwise direction. Along with that, since the separation part 12 is screwed with the upper closure 20 through reverse threads, the separation part 12 is subjected to an action of moving upward with respect to the upper closure 20. At that time, since the separation part 12 is screwed with the upper closure 20 through reverse threads substantially to the deepest position, further tightening is not performed or tightening somewhat progresses and enters a lock state where movement to the direction of the upper closure 20 is prevented. Namely, the separation part 12 is moved upward together with the upper closure 20 while rotating in the counterclockwise direction when seen from above with respect to the body part 10*b*. During that period, since a stress concentrates on the notch 18 or the score 15*a* of the inner plug 10, the connection part 15 is sheared, the separation part 12 is removed from the cylindrical base part 11*a* and the plug is opened. In such opening of the plug, since the separation part 12 is elevated together with the upper closure 20 while rotating, a clear opening feeling can be generated when the separation part 12 is separated from the cylindrical base part 11*a* by breakage of the score 15*a*. Namely, a snap sound is generated in the opening of the plug, and a torque required for rotation of the upper closure 20 is rapidly reduced.

In this state, in the separation part 12, as illustrated in FIG. 3B, for example, the tip end part 16*t* of the cylindrical part 16 is brought into contact with the lower surface 20*t* in the recess part 23, with the result that a lock state by screwing is maintained, and is held by the upper closure 20.

Figure 5:
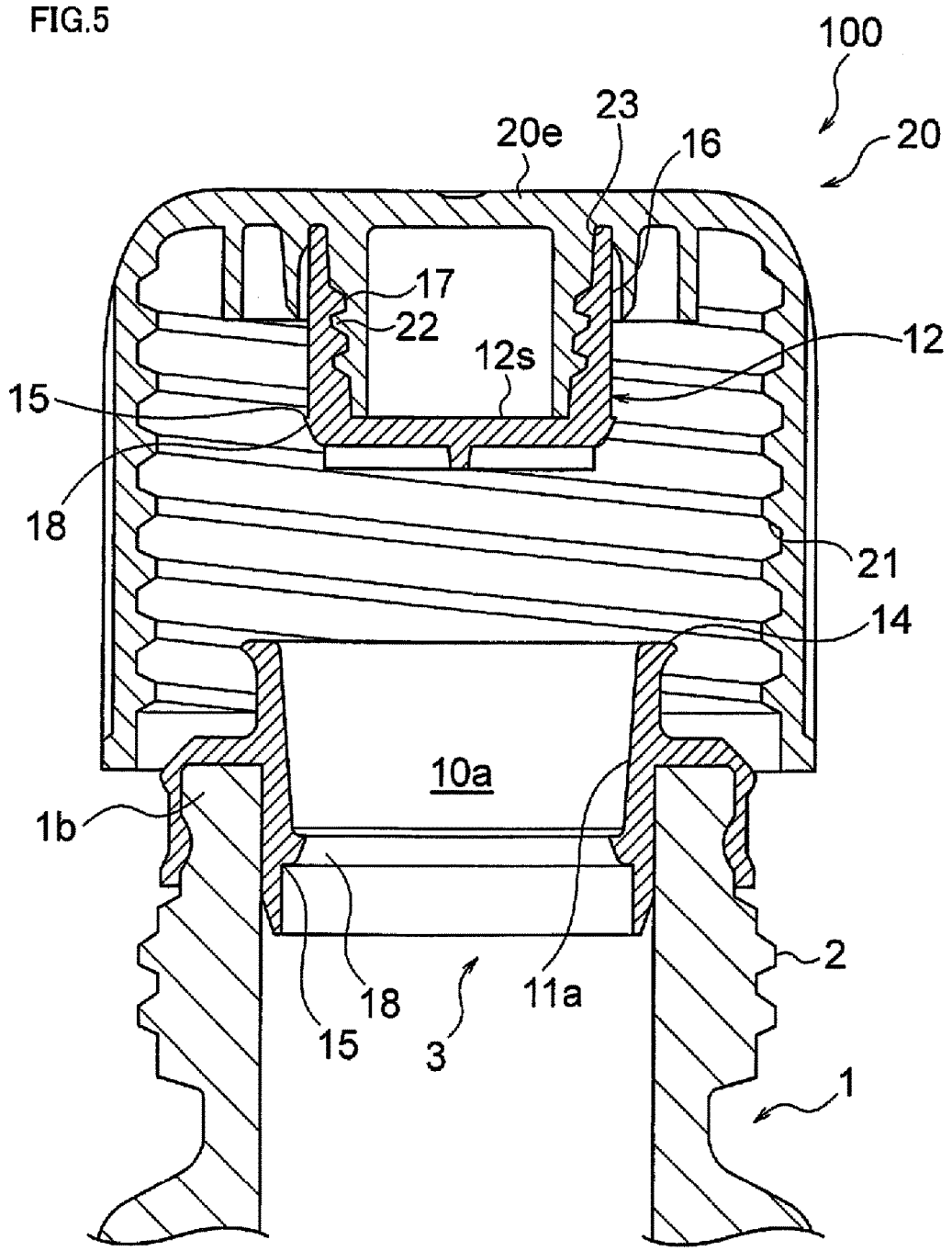
FIG. 5 is a cross-sectional view illustrating an opened state of the sealing device of the present embodiment.

Furthermore, the upper closure 20 separates from the cylindrical base part 11*a* by rotating the upper closure 20 in the loosening direction, as illustrated in FIG. 5, whereby the contents in the container 1 can be poured. At this time, the separation part 12 is ensured by the upper closure 20 and is in a lock state with respect to the upper closure 20, and thus there is no risk of removal. Namely, once being opened, the separation part 12 fixed to the inner plug 10 side is fixed to the upper closure 20 side.

A state after the opening of the plug will be described by referring to FIGS. 5, 4, and 3B. When the female thread 21 of the upper closure 20 is screwed with the male thread 2 of the mouth part 1*a* of the container 1 and the upper closure 20 is rotated in the clockwise direction, the lip part 14 formed at an upper end of the cylindrical base part 11*a* of the inner plug 10 is brought into contact with the lower surface 20*t* of the ceiling wall 20*e* of the upper closure 20, and also, the outer peripheral surface 20*g* of the middle-diameter cylinder part 20*c* is brought into close contact with the inner side surface 11*g* of the cylindrical base part 11*a* on the tip end side. As a result, sealing of the opening part 3 is achieved. Note that, in FIG. 4 and the like, the score 15*a* is not cut off, but accurately, once the opening of the plug is performed, the score 15*a* is put into a state of having been cut off.

According to the container sealing device described above, the inner plug 10 is assembled to the upper closure 20 by using the second screwing part 52 in advance. At this time, since the assembling interval between the separation part 12 and the upper closure 20 can be adjusted by the tip end parts 16*t* and 20*u* of the cylindrical part 16 which is the first stopper and the small-diameter cylinder part 20*d*, the second screwing part 52 can be brought into a lock state of being screwed to the deepest position or a state close to that. After that, the attachment of the sealing device 100 to the container 1, that is, sealing becomes possible by screwing the upper closure 20 with the inner plug 10 into the container 1. In opening the plug, the upper closure 20 is rotated in the loosening direction with respect to the container 1. Namely, the first screwing part 51 is loosened by rotating the upper closure 20 so as to be screwed back, but along with that, the second screwing part 52 which has been already substantially locked is tightened, and the separation part 12 can be rapidly and reliably separated from the body part 10*b* of the inner plug 10. As a result, after separation, that is, after opening the plug, the separation part 12 becomes less likely to be removed from the upper closure 20, and is reliably held. As described above, a clear opening feeling such as generation of a snap sound or sudden reduction in resistance against rotation can be presented by separating the separation part 12 from the body part 10*b* of the inner plug 10 while tightening the second screwing part 52 which has been substantially locked.

Hereinbefore, the container sealing device according to the present embodiment has been described, but the container sealing device according to the present invention is not limited to the above. For example, in the present embodiment, specifications such as a pitch, a winding number, a thread height and the like of the male thread 2 and the female thread 21 constituting the first screwing part 51 can be appropriately modified in accordance with application. Furthermore, the specifications such as a pitch, a winding number, a thread height and the like of the male thread 22 and the female thread constituting the second screwing part 52 can also be appropriately modified in accordance with application.

The cylindrical part 16 of the inner plug 10 and the small-diameter cylinder part 20*d* of the upper closure 20 can be switched inside and outside. Also in this case, the male thread of the cylindrical part 16 and the female thread of the small-diameter cylinder part 20*d* constitute the second screwing part 52 in the reverse thread relation with respect to the first screwing part 51.

Figure 6:
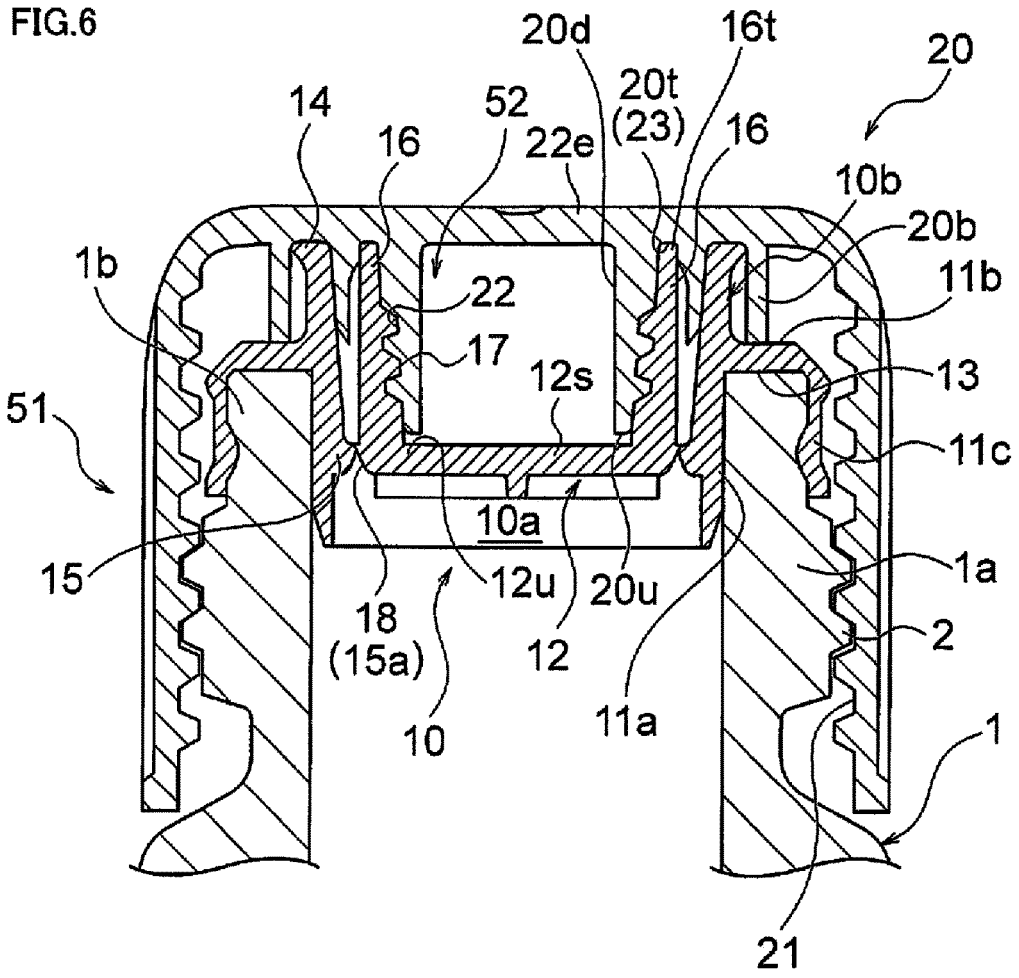
FIG. 6 is a cross-sectional view for explaining a container sealing device according to a modification.

As illustrated in FIG. 6, as a state before opening of the plug, the tip end part 20*u* of the small-diameter cylinder part 20*d* of the upper closure 20 can be spaced away from the inner-surface corner part 12*u* of the separation part 12. Alternatively, although not shown, the tip end part 16*t* of the cylindrical part 16 of the inner plug 10 can be spaced away from the lower surface 20*t* of the ceiling wall 20*e* of the upper closure 20. However, when either one of the tip end parts 20*u* and 16*t* is spaced away, the tip end part 20*u* on an inner side is preferably spaced away from the inner-surface corner part 12*u* from the viewpoint of preventing removal or the like of the separation part 12 by protecting the second screwing part 52 from the contents in the container 1.

In the above, it is assumed that, in a state where the inner plug 10 is set on the upper closure 20 before sealing, the both are tightened to the deepest position, but at that time, the tip end part 20*v* of the large-diameter cylinder part 20*b* functioning as the second stopper can also be somewhat spaced away from the upper surface 11*v* of the flange part 11*b* of the inner plug 10. However, if the interval between the tip end part 20*v* and the upper surface 11*v* is too large, stress is easily applied between the cylindrical base part 11*a* and the cylindrical part 16 when the upper closure 20 is to be screwed into the container 1 together with the inner plug 10 and is fitted, and thus it is necessary to pay attention.

The female thread 17 and the male thread 22 constituting the second screwing part 52 are not limited to those formed continuously and spirally, but can be composed of a plurality of separate parts.

In the above, assumption is made that the container 1 has a bottle shape of a PET bottle or the like. However, the container 1 is not limited to the bottle as described above, but can have a bag shape made of a film or can be any other polygonal paper packages. At this time, the inner plug 10 can have a spout shape with a flange and can be fixed to the container by fusion or the like.

The first screwing part 51 may be provided not only between the upper closure 20 and the container 1, but also between the upper closure 20 and the inner plug 10 fixed to the container 1. When the first screwing part 51 is provided between the upper closure 20 and the inner plug 10, at least either one of the first screwing part 51 and the second screwing part 52 is forcedly pushed in and fitted, in assembling. Therefore, it is possible to facilitate mounting of the inner plug 10 to the upper closure 20 by, for example, forming the thread of the first screwing part 51 or the second screwing part 52 into a shape that can be easily pushed in.

What is claimed is:

1. A container sealing device provided with an inner plug and an upper closure and enabling attachment and detachment of the upper closure by a first screwing part provided between the upper closure and a container or the inner plug, wherein:

the inner plug has a body part releasably coupled to a separation part such that an opening is formed when the separation part detaches from the body part;

the upper closure has a support part for the separation part provided in the inner plug;

the separation part is coupled to the support part by a second screwing part provided between the support part and the separation part;

the second screwing part is in a reverse thread relation with respect to the first screwing part; and a first stopper is provided between the separation part and the upper closure, wherein the separation part is screwed onto the second screwing part to a depth that the first stopper forms a contact between an upper end of the separation part and the upper closure and/or a lower end of the support part and the separation part, thereby preventing significant further advancement of the separation part onto the second screwing part, wherein a second stopper is provided forming a contact between the upper closure and the body part of the inner plug, and wherein the second stopper is provided at a lower end of a second inner cylinder part provided at the upper closure.

2. The container sealing device according to claim 1, wherein the support part has a first inner cylinder part extending downward from a lower surface of a ceiling wall of the upper closure, the separation part has a cylindrical part extending upward from a sealing body connected to the body part of the inner plug, and the second screwing part is provided between the first inner cylinder part of the support part and the cylindrical part of the separation part.

3. The container sealing device according to claim 2, wherein the second screwing part has a male thread formed on an outer side surface of the first inner cylinder part of the support part, and wherein a female thread formed on an inner side surface of the cylindrical part of the separation part.

4. The container sealing device according to claim 1, wherein the first stopper is provided at least at either one of a lower end of the first inner cylinder part provided at the support part and an upper end of the cylindrical part extending upward from the sealing body provided on the separation part.

5. The container sealing device according to claim 1, wherein the upper closure has a recess part in which a tip end of the cylindrical part extending upward from the sealing body of the separation part is accommodated.

6. The container sealing device according to claim 1, wherein a score is provided between the body part of the inner plug and the separation part.

7. The container sealing device according to claim 1, wherein the body part of the inner plug is configured to be not deformed by the second stopper.

8. The container sealing device according to claim 1, wherein the second stopper extends in a first direction, and wherein the body part extends in a second direction that is substantially perpendicular to the first direction.

9. The container sealing device according to claim 1, wherein the second stopper is configured to maintain an interval between the body part of the inner plug and the upper closure.

10. The container sealing device according to claim 1, wherein the second stopper has a bottom surface facing the inner plug, and wherein the bottom surface contacts the body part of the inner plug.

* * * * *